US008494202B2

(12) United States Patent
Karamuk

(10) Patent No.: US 8,494,202 B2
(45) Date of Patent: Jul. 23, 2013

(54) REPLACEABLE HEARING PROTECTION MEMBRANE FOR HEARING DEVICES

(75) Inventor: Erdal Karamuk, Meilen (CH)

(73) Assignee: Phonak AG, Stafa (CH)

( * ) Notice: Subject to any disclaimer, the term of this patent is extended or adjusted under 35 U.S.C. 154(b) by 273 days.

(21) Appl. No.: 12/853,423

(22) Filed: Aug. 10, 2010

(65) Prior Publication Data

US 2010/0319189 A1 Dec. 23, 2010

Related U.S. Application Data

(62) Division of application No. 11/125,995, filed on May 10, 2005, now Pat. No. 7,793,756.

(51) Int. Cl.
*H04R 25/00* (2006.01)

(52) U.S. Cl.
USPC ..... 381/329; 381/325

(58) Field of Classification Search
USPC ..... 381/325, 329
See application file for complete search history.

(56) References Cited

U.S. PATENT DOCUMENTS 4,349,083 A 9/1982 Bennett
4,953,215 A 8/1990 Weiss et al.
4,987,597 A 1/1991 Haertl
5,278,360 A 1/1994 Carbe et al.
5,452,731 A 9/1995 Dickman
5,488,961 A 2/1996 Adams
5,864,628 A 1/1999 Posen et al.
6,105,713 A 8/2000 Brimhall et al.
6,129,174 A 10/2000 Brown et al.
6,134,333 A 10/2000 Flagler
6,164,409 A 12/2000 Berger
6,310,961 B1 10/2001 Oliveira et al.
6,691,822 B2 2/2004 Meussen et al.
6,795,562 B1 * 9/2004 Gunnersen et al. ..... 381/325
6,813,364 B1 11/2004 Vonlanthen
6,879,696 B1 4/2005 Vonlanthen
6,938,621 B1 9/2005 Greenhaw et al.
7,013,016 B2 3/2006 Wolf
2003/0159878 A1 8/2003 Hakansson et al.
2003/0219138 A1 11/2003 Vonlanthen et al.
2004/0105562 A1 6/2004 Kulman
2005/0169492 A1 8/2005 Topholm
2006/0042865 A1 3/2006 Berg et al.
2007/0003087 A1 1/2007 Ram et al.

* cited by examiner

*Primary Examiner* — Davetta W Goins
*Assistant Examiner* — Amir Etesam
(74) *Attorney, Agent, or Firm* — Pearne & Gordon LLP

(57) ABSTRACT

A device as hearing aid to be worn in the ear or in or at the auditory canal comprises at least a sound or acoustic exit opening with a protection element (10) to prevent the contamination of the device. The protection element (10) comprises a thin, at least almost flexible or elastic membrane (15) made out of a thermoplastic polymer.

20 Claims, 6 Drawing Sheets

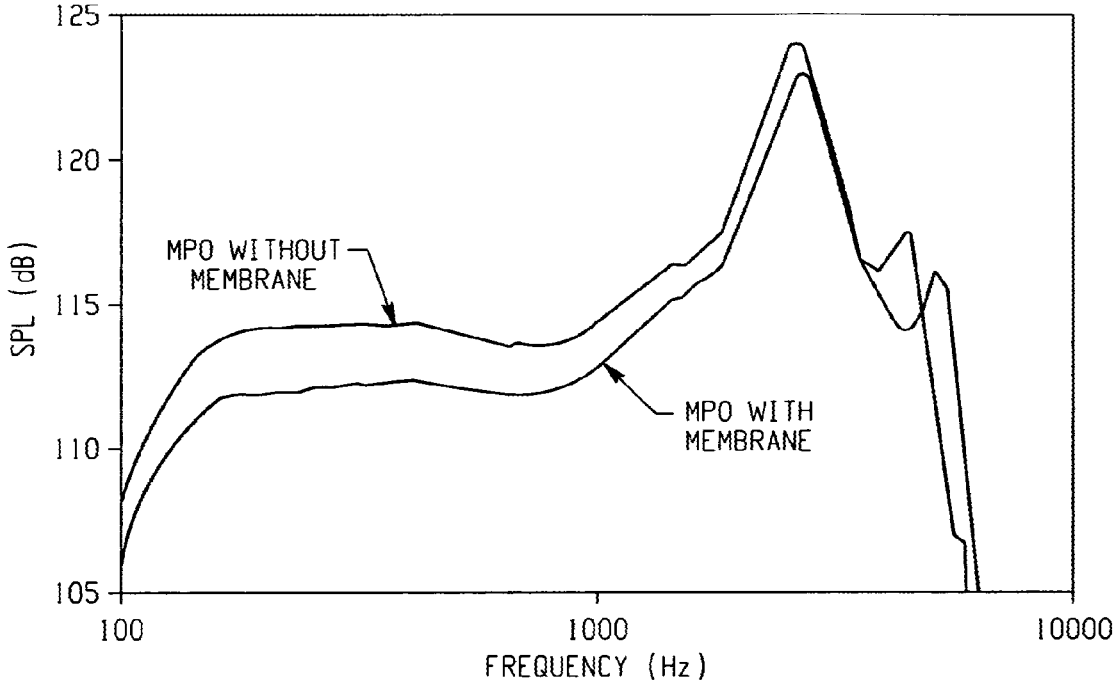
Fig. 3
Fig. 4
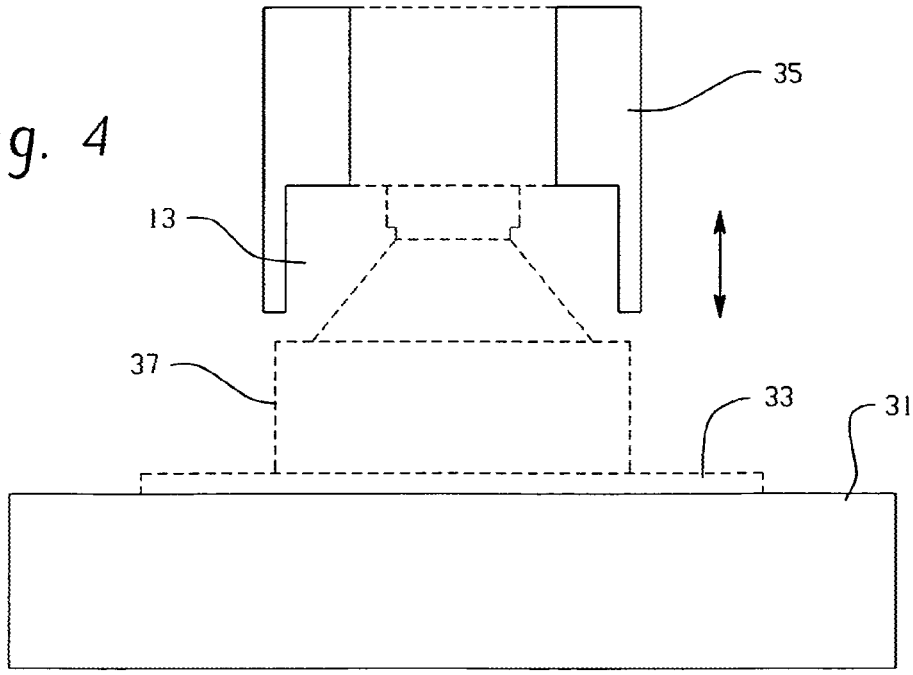

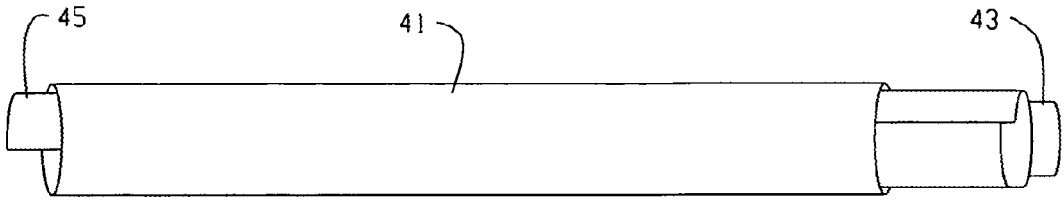
Fig. 5
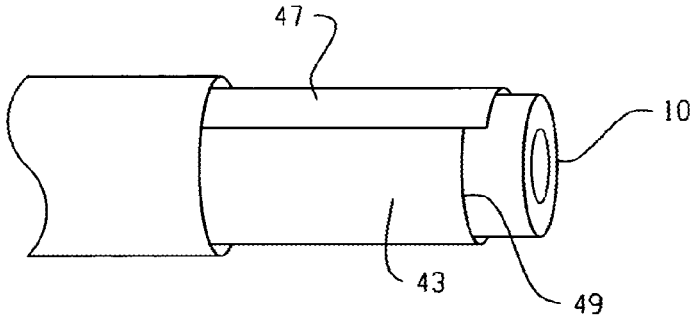
Fig. 6
Fig. 7
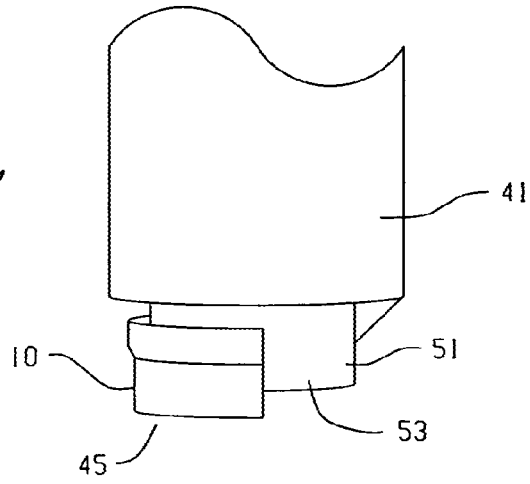

REPLACEABLE HEARING PROTECTION MEMBRANE FOR HEARING DEVICES

BACKGROUND OF THE INVENTION (1) Field of the Invention

The present invention refers to a hearing aid device to be worn in the ear or in or at an auditory canal. A process is provided for the production of a protection element for the device, an installation tool for the assembly and the removing of the protection element from the hearing device respectively as well as a process for the installation of a protection element.

In particular, in in-the-ear hearing aids or hearing devices respectively, the problem exists that at the acoustic exit of the hearing device towards the inner ear, contamination, in particular caused by cerumen, can occur.

(2) Description of Related Art

In particular at in-the-ear hearing aids or hearing devices respectively the problem exists that at the acoustic exit of the hearing device towards the inner ear contamination, in particular caused by cerumen, can occur.

In the state of the art a number of measures are known to prevent or at least to reduce essentially the contamination by cerumen of an-the-ear hearing device. Usually the use of a membrane as earpiece protection at in-the-ear hearing devices is proposed. Such membranes are described within a plurality of former publications.

In the U.S. Pat. No. 4,987,597 the use of a microporous membrane is described which can be attached replaceably on sound exit openings e.g. of hearing devices.

In the U.S. Pat. No. 6,164,409 a rigid, non-sound permeable membrane is described which hermetically is sealing the sound exit opening of an in-the-ear hearing device. The membrane is shifted in oscillation by the earpiece and creates sound waves which are similar in frequency and amplitude.

In the DE 19 640 796 A1 a hearing device is described, at which the earpiece is separated from the eardrum by a membrane. Proposed is a thin titanium membrane which can be attached onto the sound exit socket of the hearing device by means of a cap. A similar system is proposed within the EP 0 835 042 A2. A thin titanium membrane is shaped by a respective surface stamping and a concave or convex forming respectively as acoustic filter or acoustic lens.

Also in the U.S. Pat. No. 4,953,215 a membrane is mentioned made out of a non-porous material, which at least contains a small bore as sound exit opening, this opening must be at least bigger than the membrane thickness by a factor 10, to obtain the acoustical transparency.

Also at behind-the-ear devices (HdO) the use of membranes has already been described. For instance within the WO-A-0045617 a treatment equipment is described which contains a sound exit opening which is sealed by an acoustically permeable, waterproof film.

The DE 101 04 129 A1 describes a hearing device with a filter unit which contains a membrane or sieve-like filter element. To enlarge the active cross-section area for the sound transfer the filter element is arranged in an inclined position. A similar arrangement is also described within the DE 102 14 189 B4. Here a relatively great membrane parallel to the ear canal axis is arranged and exposed to sound of an ear piece. The emitted sound is radiated over a small gap at the front area of the hearing device bowl to the eardrum.

Also the EP 0 629 101 A1 describes a membrane which does not only enclose the sound entrance and the sound exit opening, but also the outer skin of the hearing aid bowl and can be adapted by plugging of the internal space to the anatomy of the auditory canal. This membrane is not replaceable but integral part of the bowl.

The EP 0 548 580 A1 describes an earpiece for hearing devices which is protected by means of an outer membrane against cerumen and humidity. Again here the membrane is note replaceable but integral part of the earpiece.

BRIEF SUMMARY OF THE INVENTION

The proposal to close hermetically the earpiece of a hearing device by means of a membrane contains five problem areas, which within the present invention shall be solved:

1. Mechanical Properties of the Membrane Sound Transfer:

As generally known the transmission properties of big membranes are better than those of small ones. At the application as hearing protection in hearing devices the maximal diameter, which means the desired fitting rate, is limited by the ear canal geometry. Besides the diameter also the membrane thickness and the material properties such E modul, Poisson number, density, do have an influence on the sound transmission. Therefore, it is an object to optimize those factors for a given diameter to achieve an optimal sound transmission.

2. Acoustic Coupling of the Earpiece to the Membrane:

A membrane as earpiece protection must be coupled acoustically to the earpiece such that abrupt cross-section changes and therefore impedance jumps can be avoided. Usually, the earpiece is fixed via a sound path tubing at the bowl of the hearing device. Therefore, a mechanical coupling of the tubing diameter, which usually represents approximately halve of the membrane diameter, to the membrane has to be found, whereby the above mentioned points have to be taken into consideration.

3. Assembly Expenses in the in-the-Ear Laboratory:

The assembly expenses within an in-ear laboratory contribute essentially to the overall costs of an in-the-ear (IdO) hearing device. A system for cerumen protection therefore must be simple to be installed, so that no additional time effort occurs within the laboratory.

4. Cleaning of the Membrane in the Daily Use:

A membrane does indeed protect the earpiece efficiently against humidity and cerumen, but is itself exposed to all those environmental factors. In the daily use it must be possible therefore that the membrane can be cleaned regularly to remove depositions of cerumen, which may influence substantially the acoustic properties. This has to be taken into consideration when shaping mechanically the membrane and further elements.

5. Installation and Removing the Membrane:

In case that the membrane is quite contaminated or damaged the possibility has to exist that it can be replaced. The replacement of the membrane should not only be possible for a service technician, but also for the hearing device acoustician or the person wearing the hearing device. Therefore, a tool has to be made available which facilitates the installation as well as the removing of the membrane. Attention has to be paid that at the insert of the filigree membrane it is not damaged and at the removing no contamination can enter into the sound exit opening.

As a consequence, the object of the present invention is to solve the above mentioned five problem topics at least partially.

In the U.S. Pat. No. 6,813,364 B1 the use of a membrane as closure of a hearing modulus for hearing devices is described which is worn in the ear or at the ear, but without describing in details the membrane element, in particular its design, its production and its use. In such sense the present invention specifies the proposed elements known out of the U.S. Pat. No. 6,813,364 B1.

Proposed is a device as a hearing aid worn in the ear or in or at the auditory canal respectively, comprising at least a sound or acoustic exit opening with a protection element to prevent the contamination of the hearing aid, the protection element comprising a thin, at least nearly flexible or elastic membrane e.g. made out of an elastomer or a thermoplastic polymer. The protection element is at least nearly integrally arranged within the wall of a housing or a protection bowl of the device or the hearing aid.

According one execution layout the protection element comprises at least a nearly circular, cylinder-like body or carrier member consisting of a preferably heat-conducting material, one opening of the body or carrier member, preferably the one opening seen from the device directed towards the outside is covered or closed by the flexible membrane.

The surface of the inner channel of the carrier membrane or the cylinder is such conus-like shaped that the diameter of the inner channel from the outer opening, covered by the membrane towards the opening directed towards the interior of the hearing aid is shaped in a tapering manner.

The membrane consists preferably of an elastomeric or rubber-elastomeric polymer such as e.g. polyurethane, synthetic rubber, Butadiene-styrene-copolymer, silicone rubber, etc. The thickness of the membrane is <30 μm, preferably <20 μm, as e.g. approximately 15 μm. The circular cylinder or carrier member consists preferably of a metallic material such as e.g. stainless steel. As an alternative also a polymer can be used which is compatible with the described production process as described below.

Further preferred design layouts of the inventive device or hearing aid respectively are characterized within dependent claims.

Further proposed is a process for the production of a protection element for a device a described above. According to the proposed process a film consisting of an elastic or flexible polymer is arranged on a substrate, afterwards the cylinder-like body or carrier member, consisting of heat-conducting material, is moved towards the membrane, the film or the cylinder-like body or carrier member respectively is being heated. Now the body or carrier member is forced against the membrane, whereon the membrane is welded by the terminal body or carrier rim and at the same time is extracted out of the film, which is made possible by a respective design of the carrier member cross-section. Afterwards, the cylinder-like body or carrier member is removed from the film together with the membrane and can be inserted into a hearing aid as protection element, which means e.g. can be arranged in the wall of the housing.

For the installation of a protection element further a mounting tool is proposed. Preferred design versions of the mounting tool also proposed.

Finally, a process for the installation of a protection element within a hearing aid or at a housing of an in-the-ear hearing device is proposed.

BRIEF DESCRIPTION OF THE SEVERAL VIEWS OF THE DRAWINGS

The invention shall be explained in more details by means of examples and with reference to the attached drawings in which:

FIG. 3 shows the typical frequency response of an in-the-ear hearing device with and without a membrane or protection element respectively;

FIG. 4 shows schematically a possible production process for the production of a protection element;

FIG. 5 shows a mounting tool for the installation or removing of a protecting element in perspective view;

FIG. 6 shows such end of the mounting tool adapted for the installation of the element;

FIG. 7 shows such end of the mounting tool adapted for the removing of the protection element;

DETAILED DESCRIPTION OF THE INVENTION

Figure 1A:
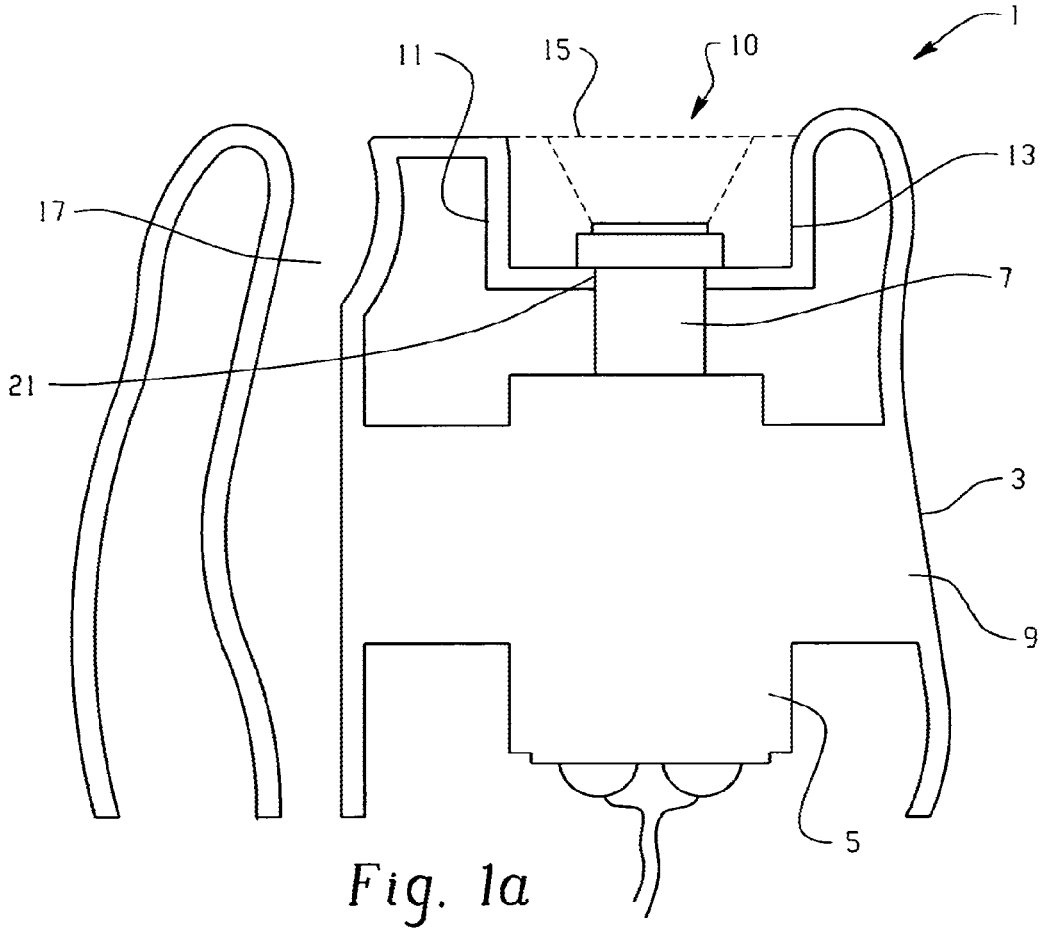
FIG. 1*a* shows in cross-sectional view the standard assembly of the end of an in-the-ear hearing device directed towards the eardrum with an inventive protection element.
Figure 2A:
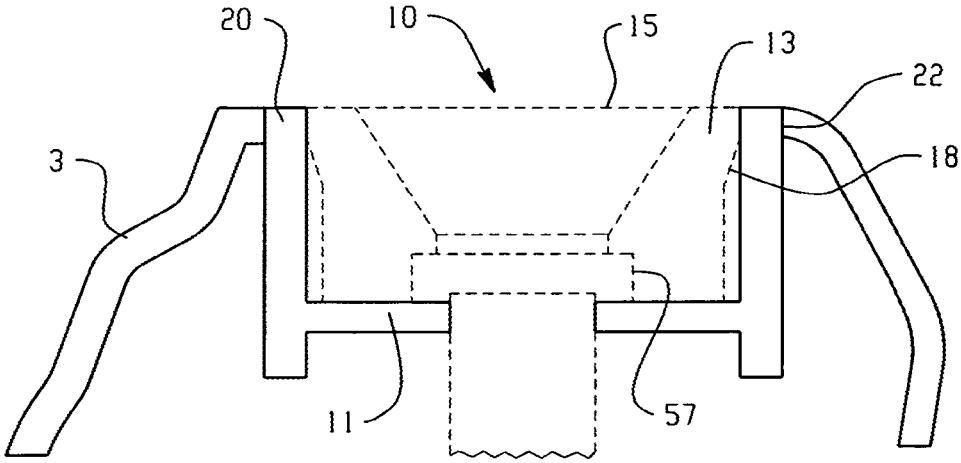
FIG. 2*a* shows in cross-sectional view a part of the section of the inserted protection element together with an additional holding device as separate mounting part.

FIG. 1*a* shows schematically as sketch drawing the standard design of the end of an in-the-ear hearing device 1 directed towards the eardrum with a membrane cerumen protection 10 arranged within the housing wall 3. The cerumen protection 10 is directly inserted into a cavity 11, which is arranged for it within the housing wall or bowl 3. The cavity 11 is an integral part of the housing wall or bowl 3 and is built up together with the bowl. As an alternative the cavity 11 can be also designed as a separate mounting part 20 which is mounted within a boring 22 arranged for it within the bowl 3, as shown in FIG. 2*a*. At the lower end of the cavity 11 there is an opening 21 which is connected by insertion into the sound conduit tubing 7. This tubing also holds firmly the earpiece 5 in its position. The earpiece 5 in addition is enclosed by a bearing element 9, which should absorb mechanical vibrations. Finally recognizable is also a ventilation compensation channel 17 to enable a pressure compensation from the inner ear towards the outside direction.

Figure 1B:
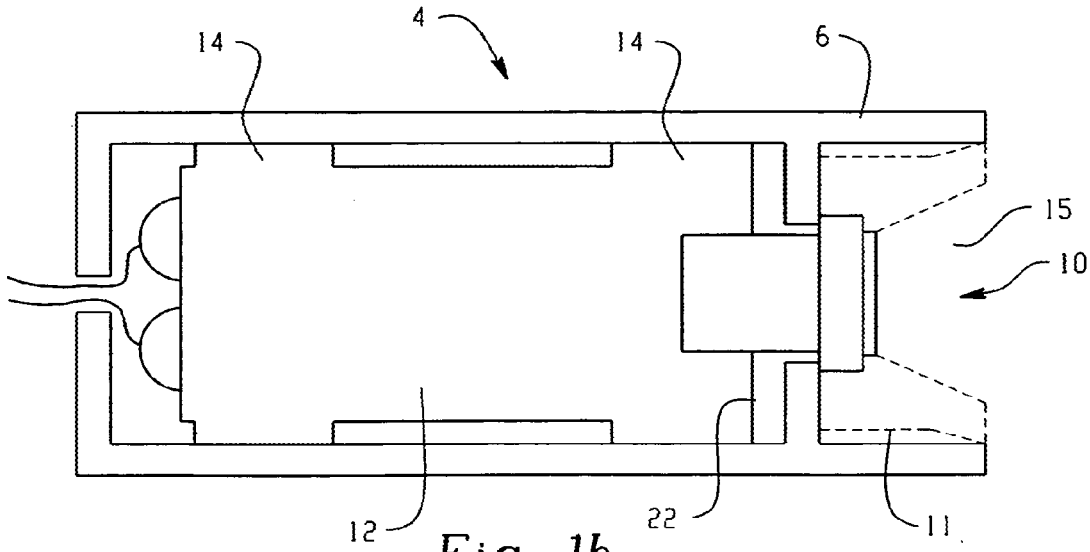
FIG. 1*b* shows a closed hearing module, which can be inserted in a in-the-ear hearing device or can be used as an external earpiece for a behind-the-ear device.

FIG. 1*b* shows a respective design for a closed hearing module 4, which can be inserted into an in-the-ear hearing device as described within the U.S. Pat. No. 6,813,364 B1, or which can be used as external loudspeaker of a behind-the-ear device within the ear. In this case the earpiece 12 is enclosed by an elastic bearing element 14 within the housing 6, which comprises a sound exit opening 11 which is designed such that the protection element 10 can be inserted and therefore the membrane 15 is forming the terminal end of the system.

Figure 2B:
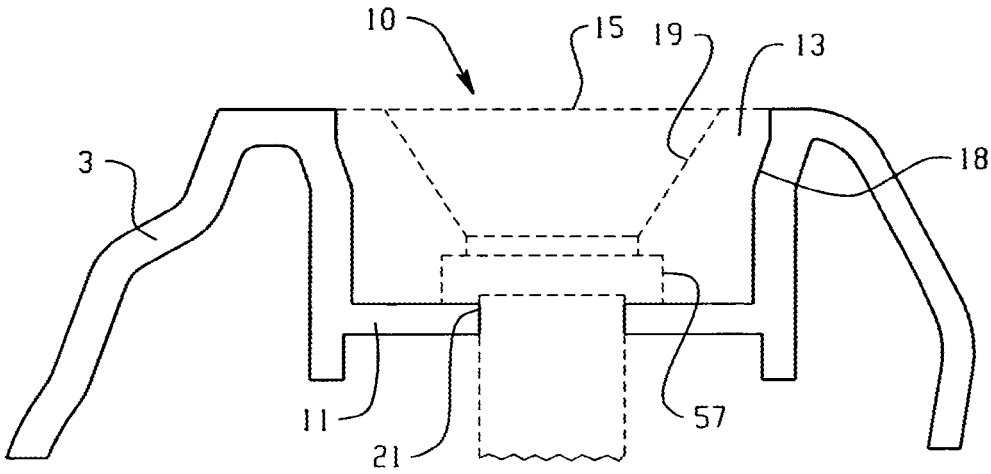
FIG. 2*b* shows in cross-sectional view part of the section of the inserted protection element with a mounting device arranged in situ within the bowl.

In particular FIG. 2*b* shows again schematically as sketch drawing the membrane cerumen protection 10 in cross-sectional view. The membrane 15 is mounted on a carrier member 13, which is inserted into the cavity 11. The cavity 11 does have a respective depth so that the membrane 15 is arranged in line to the surface of the casing. It can also be recognized that the carrier element 13 on its outside surface does not have a constant cross-section 13, which means a lateral gradation 18 is arranged which lies on a respective saddle within the cavity 11 as well as an internal terrace 57 which enables the replacement of the protection element. The inner opening of the carrier element in particular from the small tubing diameter to the greater outer diameter, covered by the membrane 15, is conically designed. The conic surface is designated with the reference No. 19.

The described invention takes care of all above discussed problems:

1. By choosing the membrane material as well as the design of the mounting element the above discussed problems can be reduced: the membrane consists out of a very thin film <30 μm, preferably <20 μm, such as e.g. a polyurethane film of 15 μm. By means of the very thin film thickness and the low E-Modul of the material the resistance to bending firmness of the membrane for a given outside diameter is reduced. The film is bonded onto the carrier element such as e.g. with a permanently elastic UV curing adhesive. But also other bonding variations are possible, such as e.g. by means of welding with induction, high-frequency or temperature/laser. A process for mounting the membrane is described by the way with reference to FIG. 4. To ensure a pressure compensation without changing the acoustic properties also an opening within the membrane with a diameter of a few μm can be arranged. E.g. by means of a laser beam a hole with a diameter of approx. 30 μm can be placed. To achieve a fit rate as big as possible the diameter of the vibrating membrane is kept below 3 mm. This enables the use of a cerumen protection also at an in-the-ear hearing device with very small dimension, as e.g. an in-the-ear channel hearing device (CIC).
2. The optimal acoustic coupling of the hearing exit or the sound tubing onto the cerumen protection membrane is achieved by arranging a tapered passage 19 in the carrier part. Thereby, impedance steps which are created by sudden changes of cross-section are prevented. Thereby, also the air volume which is moved between the hearing membrane and the cerumen protection membrane is further reduced, which also has a positive effect for damping.
3. The cavity 11 for the cerumen protection can be built in by means of modern additive production processes for hearing device bowls in situ with the bowl like e.g. with selective laser sintering (SLS) or stereolithography (SLA). Thereby, additional steps at the production of the bowl for the installation of a cerumen protection system within an in-the-ear laboratory can be omitted. At a closed hearing modulus 4 for in-the-ear hearing devices or as external earpiece for behind-the-ear hearing devices such as shown in FIG. 1*b* the cavity 11 can be shaped as integral part of the hearing housing 6. The earpiece is installed as a standard procedure by means of a hearing tubing and a bearing and afterwards the carrier member together with the membrane is simply pushed into the opening within the bowl, which is provided for this purpose. With a tool provided for this purpose as later described with reference to FIG. 5 and following the cerumen protection can be replaced.
4. The cleaning effort for the hearing device can be kept on a minimal level by use of the described membrane solution. Due to the fact that the membrane 15 corresponds aligned to the outer outline of the hearing device bowl contaminations or depositions of cerumen on the bowl or on the membrane can be removed by a simple dusting off procedure of the device with a humid towel. Persistent depositions can be removed mechanically by means of a soft brush. Both procedures are known to hearing device wearing persons. By use of the membrane material which has a very high elongation at break of more than 500% the risk that the membrane may be damaged at cleaning can be essentially reduced. If the membrane shall be damaged mechanically or the damping despite cleaning increases after a certain time the membrane can be replaced by the acoustician or by the hearing device wearing person itself. As membrane materials suitable are in particular elastomeric polymers and rubber-elastomeric polymers as e.g. the above mentioned polyurethane, further high-tear-proof rubberlike materials such as e.g. synthetic rubber, butadiene-styrene-copolymers, silicone rubber, etc.
5. Mounting and removing the membrane is further described later on with reference to FIGS. 8 and 9. In particular a tool 41 is presented which enables to insert the cerumen protection without damaging the membrane. It also is shown how the cerumen protection can be removed without dirt particles getting into the sound exit opening of the earpiece.

FIG. 3 shows a typical frequency response of an in-the-ear hearing device with and without a membrane. It can be recognized that by means of the membrane a broadband damping of approx. 2 dB occurs. This results due to the inner damping of the membrane material and the dullness of the membrane. Therefore, at the adaptation of a hearing device a respective reserve for the compensation of the membrane damping has to be taken into consideration.

FIG. 4 shows schematically a possible mounting of a membrane onto a carrier 13 for the production of a respective protection element 10. A film 33 is applied on a support member 31, the film consisting of such kind of polymer which is suitable for forming the membrane. By means of a gripper element 35 the carrier 13 is held and is lowered towards the film 33 arranged on the support member 31. As soon as the front side border 37 of the carrier or the body 13 abuts the film 33 the film material will be sintered or welded respectively along the borderline 37. This can be achieved either by heating the film 33 on the support member 31 or by heating the carrier 13 which preferably consists out of a heat conductive material. By sintering or welding the membrane to the carrier 13 at the same time the membrane shall be removed out of the film 33, whereafter the gripper element 35 can be removed from the support element 31. Now the membrane 15 is arranged on the carrier 13 and the protection element can be inserted into the cavity of a hearing device wall. This process shall be described afterwards with reference to FIG. 5 ff in more details.

FIG. 5 shows in perspective view a tool or installation tool 41, by means of which the cerumen protection element can be arranged within the housing wall as well as it can been removed out of the housing wall. The tool comprises two respectively designed ends 43 and 45. It that respect FIG. 6 shows such end 43 which is provided for the mounting or the insertion of the cerumen protection into the housing wall. For this purpose the tool comprises a circular cylinder-like end 49 which corresponds more or less to the diameter of the upper or outer border 37 respectively of the cerumen protection. Slightly relegated from the end an elastic jacket 47 is provided which outside enclosing is overlapping the end 49. This elastic jacket is dimensioned such that an outside encompassing of the outer outline of the upper border 37 of the protection element in the area of the membrane is possible. The elastic jacket 47 can be made out of the same material as the end 43 and can have elastically resilient properties by corresponding designing or can be made out of a rubber-elastic material like an elastomer or a thermoplastic elastomer and can be mounted as additional element on the end 43 or can be integral with the end 43, e.g. by use of a 2K injection molding process. For simplification reason within the description always a rubber jacket is mentioned. With reference to FIG. 8 the mounting itself shall be described in more details.

The opposite end of the tool 41 is shown in FIG. 7, where a cylinder-like removing element 51 is arranged at the end 45 of the tool 41. The removing element 51 comprises preferably at the terminal end an engaging projection 53, the function of which shall be described in more details with reference to FIG. 9.

Figure 8C:
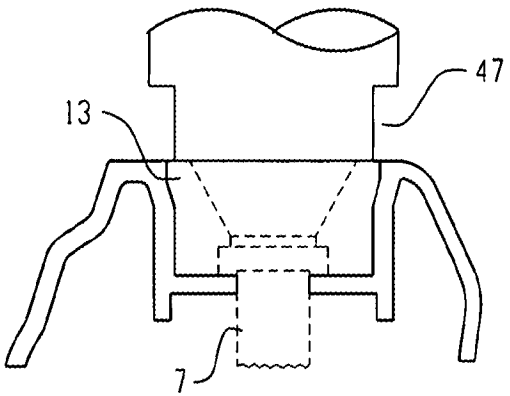
FIGS. 8*a-c* show the mounting process for the protection element into the wall of the housing of an in-the-ear hearing device.
Figure 8B:
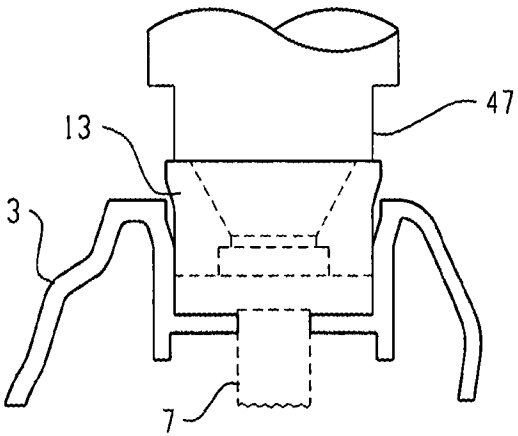
Figure 8A:
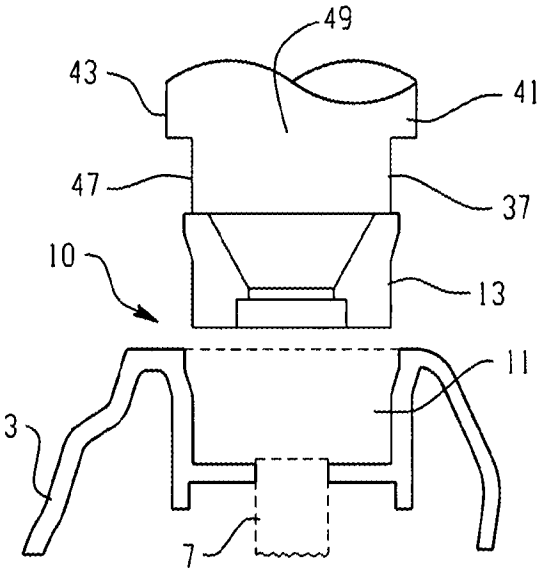

FIG. 8 shows by use of the three illustrations a), b) and c) the installation process for inserting a protection element 10 into the cavity 11 of an in-the-ear hearing device. For that reason according to FIG. 8*a* a cerumen protection or carrier element 13 is held with the tool 41 by means of an outside-embracing rubber-elastic jacket 47. FIG. 8*b* shows the insertion of the carrier 13 into the cavity 11, whereby the outside-embracing rubber jacket 47 abuts to the housing wall 3. Due to the rubber-elastic design the jacket 47 can be compressed as shown in FIG. 8*c*. As soon as the carrier or mounting member together with the membrane, which means the cerumen protection element, is totally inserted within the cavity 11 the tool 41 can be removed upwardly without removing again the element out of the cavity 11.

Figure 9C:
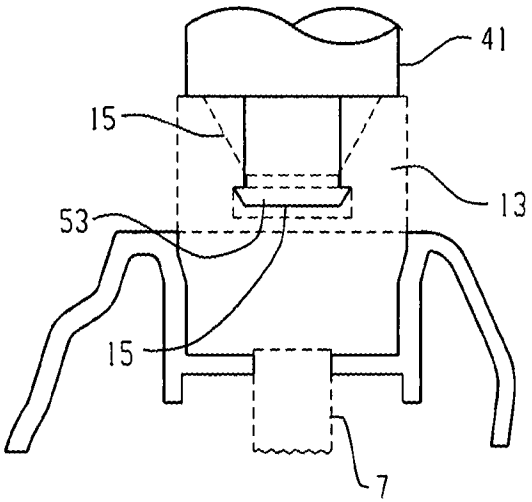
FIGS. 9*a-c* show the removing of the protection element out of the housing.
Figure 9B:
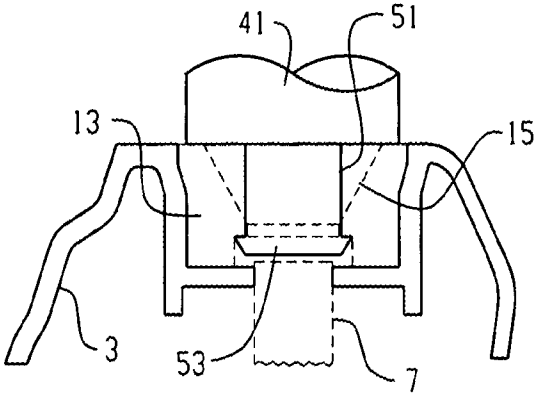
Figure 9A:
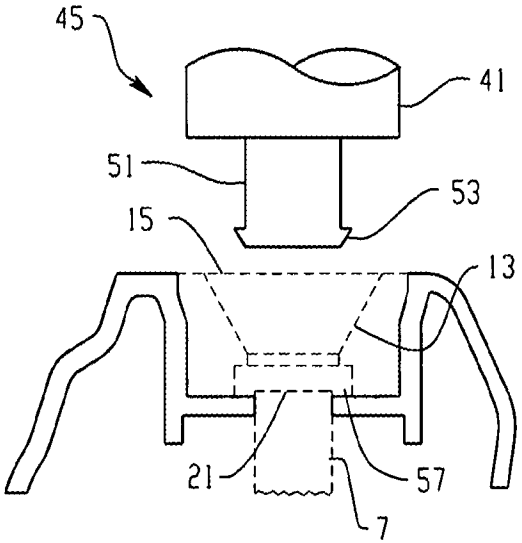

Removing the protection element out of the cavity 11 is executed by means of the other end of the tool 41 as schematically described with reference to FIGS. 9*a*-9*c*. For that reason the removing element 51 together with the terminal engaging projections 53 is moved towards the membrane 15 of the protection element and is pressed together with the membrane towards the lower tapered opening 21 in the body or carrier 13. Due to the high tensile strength of the membrane 15 it can not be broken through or cut through but is stretched by the removing element 51, which is preferable to avoid contamination of the earpiece in the hearing aid. As soon as the removing element 51 is totally inserted the laterally projecting engaging projections 53 are engaging into the respective recesses 57 within the inner wall of the carrier 13 so that now the protection element can be removed out of the cavity 11.

Due to the design of the protection element and by use of the tool as shown in FIGS. 5-7 it is at any time possible in a simple manner to replace the cerumen protection. With other words the cerumen protection can also be replaced by a person who is using the hearing aid.

The devices, elements and tools as shown in FIGS. 1-9 are of course only examples which can be changed in any manner, modified or amended by further elements. So it is possible instead of the mentioned polymer materials to use other suitable materials for the production of the membrane. Also the carrier member or body of the cerumen protection element can be made out of any kind of suitable material, whereby preferably a good heat-conductive and heat-resistant material as e.g. a fiber-reinforced polymer is used to enable a simplified mounting of the membrane onto the carrier member as described in more details with reference to FIG. 4. Also the tool described with reference to the FIGS. 5-7 does only represent an example which does not have to be obligatorily rod-shaped. Also another design of a tool can be used at which a rubber-like material as e.g. some kind of a rubber tube is arranged to place the protection element within the hearing device, and on the other side also a removing element or an engaging element can be provided that contains at the terminal end a rough outline so that by engaging within the inner conus of the carrier or body it can be removed again out of the hearing aid.

The invention claimed is:

1. A tool for the installation and removal of a protection element in a hearing aid comprising:

an elongated body having a first end and a second end;

a jacket positioned at the first end of the elongated body, the jacket overlapping the elongated body and extending beyond the end of the elongated body, the jacket configured to engage an outer outline portion of the protection element such that the protection element can be inserted into a cavity, the jacket comprising a flexible material having a diameter larger than an outer diameter of the protection element; and a removing element positioned at the second end of the elongated body, the removing element including an engaging member configured to engage and grip the protection element such that the protection element can be removed from the cavity.

2. The tool according to claim 1, wherein the elongated body is cylindrically shaped.

3. The tool according to claim 1, wherein the jacket is configured to overlap the first end of the elongated body.

4. The tool according to claim 3, wherein the jacket is configured to surround a border of the protection element.

5. The tool according to claim 1, wherein the jacket consists of a material with elastic resilient properties.

6. The tool according to claim 5, wherein the first end of the elongated body is made of the same material as the jacket and comprises elastic resilient properties.

7. The tool according to claim 1, wherein the jacket is integrally arranged with the first end of the elongated body.

8. The tool according to claim 1, wherein the engaging member includes at least one projection.

9. The tool according to claim 8, wherein the protection element includes a membrane covering a portion of the protection element such that the removing element engages the membrane when the engaging member engages and grips the protection element without penetrating the membrane.

10. A tool for the installation and removal of a protection element in a hearing aid comprising:

an elongated body having a first end and a second end; and a jacket positioned at the first end of the elongated body, the jacket comprising a flexible material having a diameter larger than an outer diameter of the protection element;

wherein the jacket is configured to selectively hold the protection element such that the protection element can be inserted into a cavity; and wherein the second end is configured to remove the protection element from the hearing aid.

11. The tool according to claim 10, wherein the elongated body is cylindrically shaped.

12. The tool according to claim 10, wherein the jacket is configured to overlap the first end of the elongated body.

13. The tool according to claim 12, wherein the jacket is configured to surround a border of the protection element.

14. The tool according to claim 10, wherein the jacket consists of a material with elastic resilient properties.

15. The tool according to claim 10, further including a removing element positioned at the second end of the elongated body, the removing element configured to engage the protection element such that the protection element can be removed from the cavity.

16. A tool for the installation and removal of a protection element in a hearing aid comprising:

an elongated body having a first end and a second end, wherein the first end is configured to install the protection element in the hearing aid;

a jacket positioned at the first end of the elongated body, the jacket comprising a flexible material having a diameter larger than an outer diameter of the protection element, wherein the jacket overlaps the elongated body and extends beyond the end of the elongated body, the jacket is configured to encompass the outer diameter of the protection element, and the jacket is configured to selectively hold the protection element such that the protection element can be inserted into a cavity; and a cylindrical-shaped removing element positioned at the second end of the elongated body, the removing element including at least one projection configured to engage a carrier of the protection element;

wherein upon insertion of the removing element into the protection element, the at least one projection engages and grips the carrier, such that the protection element can be removed from a cavity.

17. The tool according to claim 16, wherein the protection element includes a stretchable membrane covering a portion of the protection element, such that the removing element engages the membrane prior to engaging the carrier of the protection element without penetrating the membrane.

18. The tool according to claim 16, wherein the carrier includes at least one recess, further wherein the at least one projection of the removing element engages the at least one recess of the carrier such that the protection element can be removed from the cavity.

19. The tool according to claim 16, wherein the elongated body is cylindrically shaped.

20. The tool according to claim 19, further including a jacket arranged in the first end of the elongated body, wherein the jacket consists of a material with elastic resilient properties.

* * * * *